United States Patent [19]

Hanrot et al.

[11] Patent Number: 4,741,443

[45] Date of Patent: May 3, 1988

[54] FLUIDIZED BED FOR CONTINUOUS SEPARATION OF TWO MIXED SOLID PHASES

[75] Inventors: Jean-Pascal Hanrot, Aix-En-Provence; Jacky Volpeliere; Andre Pitour, both of Gardanne, France

[73] Assignee: Aluminium Pechiney, Gardanne, France

[21] Appl. No.: 817,146

[22] Filed: Jan. 8, 1986

[30] Foreign Application Priority Data

Jan. 8, 1985 [FR] France ..... 85 00468

[51] Int. Cl.[4] ..... B03B 4/00

[52] U.S. Cl. ..... 209/44.1; 209/467; 209/491

[58] Field of Search ..... 209/467, 472, 481, 486, 209/489, 491, 502–504, 468, 469, 466, 479, 495, 490, 44.1, 695

[56] References Cited

U.S. PATENT DOCUMENTS

| | | | |
|---|---|---|---|
| 3,105,040 | 9/1963 | Wood | 209/466 |
| 3,437,202 | 4/1969 | Kaiser | 209/467 |
| 3,444,996 | 5/1969 | Douglas et al. | 209/467 |
| 3,464,553 | 9/1969 | Hancock | 209/467 |
| 3,734,289 | 5/1973 | Pearman | 209/467 |
| 3,777,887 | 12/1973 | Johnston et al. | 209/502 |
| 4,016,053 | 4/1977 | Stankovich et al. | 204/67 |
| 4,466,542 | 8/1984 | Oetiker et al. | 209/467 |

FOREIGN PATENT DOCUMENTS

| | | | |
|---|---|---|---|
| 0058778 | 9/1982 | European Pat. Off. . | |
| 0081087 | 6/1983 | European Pat. Off. . | |
| 1122011 | 1/1962 | Fed. Rep. of Germany | 209/491 |
| 2104537 | 8/1972 | Fed. Rep. of Germany . | |
| 2166473 | 8/1973 | France . | |
| 923476 | 6/1961 | United Kingdom | 209/491 |

*Primary Examiner*—Robert B. Reeves
*Assistant Examiner*—Donald T. Hajec
*Attorney, Agent, or Firm*—Oblon, Fisher, Spivak, McClelland & Maier

[57] ABSTRACT

In a fluidized bed apparatus for separation of two mixed solid phases of which one is formed by a fluidizable powdery material and the other is formed by a material which is not fluidizable under the conditions of fluidization of the former, an enclosure is suspended by springs and formed by a lower casing portion (1) for a flow of gas and an upper casing portion (2) for a flow of fluidized powdery materials, between which there is disposed a porous fluidization wall (3), at least one conduit (4) for feeding gas to the lower casing portion (1) and at least one conduit (5) for discharging the fluidization gas from the upper casing portion (2). The upper casing (2) includes an inlet (6) for the regular introduction of the mixture of the two solid phases to be separated, an overflow (7) on a face of the enclosure for discharge of the fluidized solid phase, and an outlet for discharge of the settled solid phase. The outlet is formed by an opening (13) disposed at the level of the horizontal porous fluidization wall (3) in the partition (12) which is itself disposed towards the end of the upper casing portion (2) opposite the overflow (7). Also included is a vibrator (9) for producing periodic vibration for communicating to the porous wall a vibration having a component oriented in the opposite direction to the overflow.

5 Claims, 1 Drawing Sheet

FLUIDIZED BED FOR CONTINUOUS SEPARATION OF TWO MIXED SOLID PHASES

BACKGROUND OF THE INVENTION

1. Field of the Invention

The invention concerns an apparatus and method for the separation in a fluidized bed of two mixed solid phases, one of which is formed by fluidized powdery materials while the other is made up of materials which are not fluidizable under the conditions of fluidization of the former materials.

The term "fluidizable materials" is used to denote all materials which are well known to the man skilled in the art and which occur in a powdery form and with a granulometry and cohesion such that the speed of flow of the injected air therethrough causes, at a low rate, decohesion of the particles from each other and a reduction in the internal frictional forces. Such materials are, for example, alumina which is intended for igneous electrolysis, cements, plasters, lime (either quicklime or slaked lime), fly ash, calcium fluoride, additive fillers for rubber; starches, catalysts, carbon dust, sodium sulphate, phosphates, pyrophosphates, plastics materials in the form of powder, foodstuff products such as powdered milk, flour, etc.

2. Related Art

It is well known that many methods have been the subject of investigation and development for fluidized bed transportation of powdery materials from a storage zone to at least one consumption zone to be supplied with such materials, with the zones being disposed at a distance from each other, such as for example a bag filling machine, a machine for putting material into containers, or a production assembly such as an extrusion press.

One problem involving the feed of alumina to ingneous electrolysis cells for producing aluminum is that of transporting a powdery material, the alumina, over a long distance. Stored in a silo of very large capacity, such material is intended for feeding processing workshops which are several hundreds of meters distant from the silo; a known solution to this problem has been the use of movable containers or a high pressure pneumatic conveyor system or mechanical transport arrangements.

Apparatuses for transporting alumina by a fluidized bed process have also been proposed. One of those apparatuses, which is intended for feeding alumina to electrolysis cells at multiple points, is described for example in U.S. Pat. No. 4,016,053. That apparatus which is proposed for conveying alumina from a storage zone to a consumption zone has a primary fluidized bed conveyor provided with means for feeding and discharging the gas used for permanently fluidizing the alumina and maintaining the primary conveyor substantially full of fluidized materials. A plurality of secondary fluidized bed conveyors are provided with the same means for feeding and discharging the fluidization gas, for receiving and transporting the powdery materials which come from the primary conveyor by maintaining them in the same state of permanent fluidization as in the primary conveyor, and apparatuses are provided for the discontinuous feed of powdery materials to each electrolysis tank.

Any apparatus for conveying a powdery material such as alumina in a fluidized bed mode operates satisfactorily as long as the material is homogenous, that is to say, as long as the powdery material to be transported constitutes a single fluidizable phase.

However, once the materials to be transported in the fluidized bed conveyors form two solid phases in a mixture with each other, one of which settles under the conditions of fluidization of the other phase, the fluidized bed conveyors suffer from serious disturbances which interfere with operation of the system and which can result in the flow of fluidized materials becoming blocked, since the materials which settle on the fluidization wall give rise to the formation of preferential gas flow paths. For that reason, transportation of alumina in fluidized bed conveyors may be adversely affected by the presence of another solid phase which settles under the conditions of fluidization of the alumina.

The problem arises in particular when recycling alumina in a system for feeding electrolysis tanks for producing aluminum. Alumina, because of its adsorption properties, is used for connecting the fluorine-bearing effluents emitted by the tanks in the operation thereof. That alumina which is charged with the collected effluent products tends to form compact agglomerates which are referred to by a term in the art as "scales" and which interfere with operation of the fluidized bed feed arrangements.

SUMMARY OF THE INVENTION

The object of the present invention is to provide an apparatus and method for separation of two mixed solid phases in a fluidized bed, one of which is formed by fluidizable powdery materials while the other phase is formed by materials which are not fluidizable under the conditions of fluidization of the former.

The apparatus according to the invention forms a fluidized bed casing or enclosure suspended by resilient means and including fluidization means formed by a lower casing portion for a flow of gas and an upper casing portion for a flow of fluidized powdery materials, between which is disposed a porous fluidization wall. At least one conduit is provided for the feed of gas to the lower casing portion, and at least one conduit is provided for the discharge of fluidization gas from the upper casing portion. The upper casing portion for the flow of powdery materials is provided with a means for introducing, at a regular flow rate, the mixture of the two solid phases to be separated, an overflow on one of the vertical faces for discharging the fluidized solid phase, a periodic vibratory means communicating to the level of the porous fluidization wall a vibration having a component which is oriented in the opposite direction to the vertical face provided with the overflow, permitting the solid phase which has settled to be displaced in counter-flow relationship, and a means for discharging the settled solid phase.

The means for introducing the mixture of the two solid phases to be separated, at a regular flow rate, may be disposed at any point whatever on the upward face of the apparatus. However, it is desirable for such means to be disposed at the opposite side to discharge of the fluidized solid phase.

The overflow which permits discharge of the fluidized solid phase to be effected by the material overflowing therefrom is provided with a flexible means for connection to the fixed downstream transportation circuit. That may be for example a corrugated rubber sleeve.

In order to provide for discharge of the settled solid phase as well as homogenous distribution thereof over the porous wall in such a way as not to disturb the conditions for formation of the fluidized bed, a periodic vibration may be produced by any source known to the man skilled in the art such as, for example, mechanical, electromagnetic, pneumatic or hydraulic. The vibrations may be controlled, for example, by a regulatable sequential timing means permitting the vibration source to be set for operating at regular interval and for a set period of time. Thus, for a vibration whose frequency is from 750 to 1500 cycles per minute with an amplitude of between 2 and 5 mm, these values corresponding to those of standard industrial equipment of the "vibrating sieve" type, the period of time for which the vibration source operates is between 1 and 3 minutes, at a rate of from 2 to 4 times per hour. In addition, such vibration must be oriented in the direction of discharge of the settled solid phase, that is to say, in the opposite direction to that of the fluidized phase; it must also have a vertical upwardly directed component with a resultant which is inclined with respect to the plane of the porous fluidization wall.

The axis of the vibratory movement preferably passes through the center of gravity of the apparatus and is inclined at an angle $\alpha$ with respect to the vertical, that can be fixed at from 0° to 70°, although that value does not constitute an absolute limit of the invention, values of between 20° and 60° being used in practice, with a preference for a value of $\alpha$ of close to 45°.

The non-fluidized or settled phase, under the influence of the periodic oriented vibration, advances in an opposite direction to that of the fluidized phase, over the porous wall which is kept horizontal or substantially horizontal. The horizontal positioning of the porous wall is in fact necessary in order not to modify the homogenous distribution of the phase which has settled on the porous wall and consequently not to interfere with the fluidization conditions. However, a departure of less than 3° from the horizontal is acceptable.

Even if the settled phase is not substantial, it cannot accumulate for a long period of time in the casing at the end of its movement in the opposite direction to the movement of the fluidized phase. It must therefore be periodically discharged from the casing and recovered by means which do not substantially interfere with fluidization of the other phase and which will be described hereinafter. It is also possible to provide a container for storing the settled phase, towards the end of the casing.

The container for storing the settled solid phase, which for example is formed by a cylindrical or polyhedric column, may itself be provided with a fluidization means, with the porous fluidization wall being horizontal or substantially so.

When the container for storing the settled solid phase is provided, it also has a means for periodic discharge of said phase, which makes it possible to isolate that container and the fluidized bed from the separation apparatus, while the apparatus is operating. Such a discharge means may be, for example, a lock or any other equivalent means of which the man skilled in the art is aware.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing, wherein.

DETAILED DESCRIPTION OF THE PREFERRED EMBODIMENT

Figure 1:
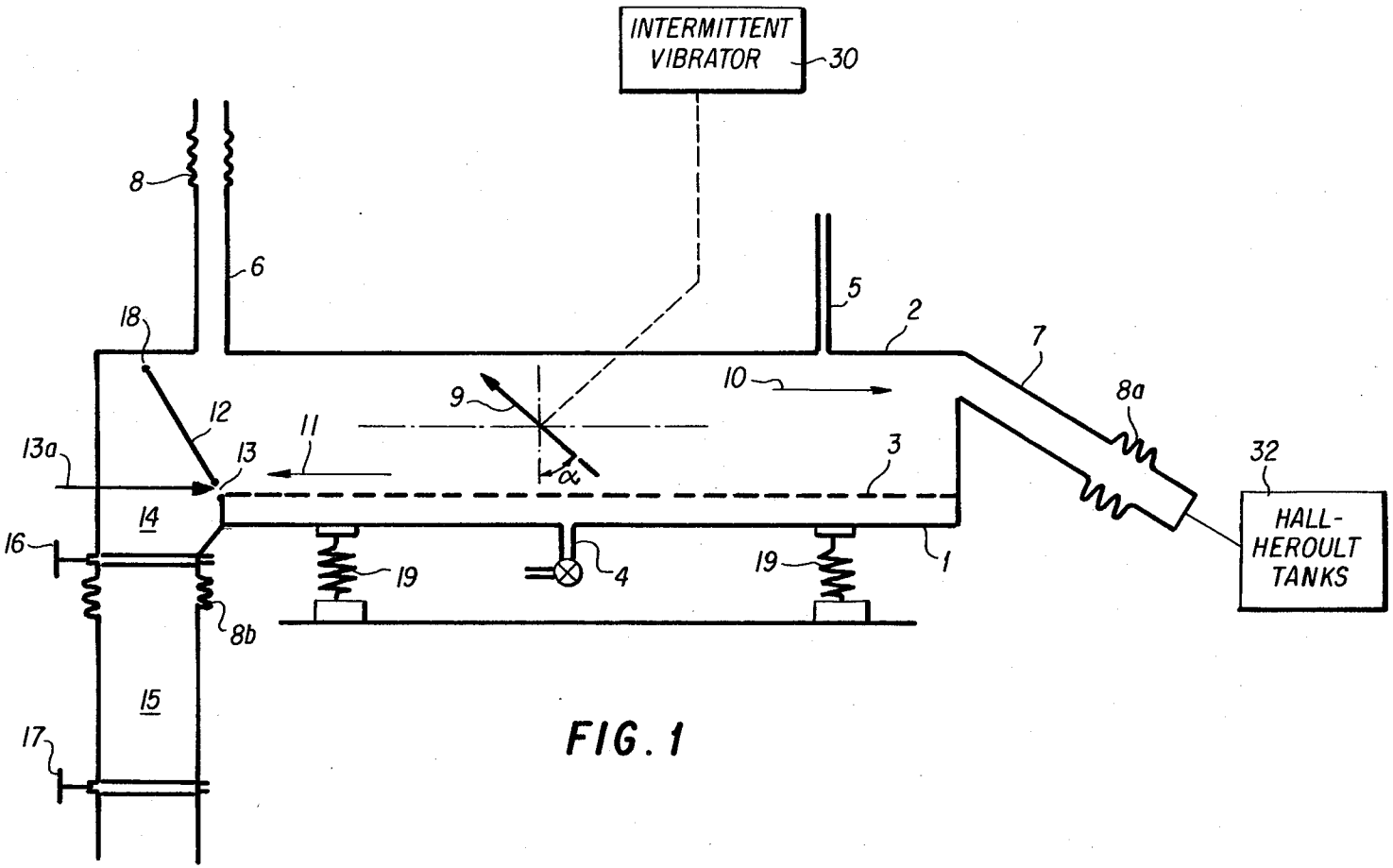
FIG. 1 illustrates an embodiment of the invention in schematic vertical section.

Referring to the drawing, the fluidized bed apparatus for separation of two solid phases comprises a closed casing having a lower casing portion 1 for a flow of gas, an upper casing portion 2, for a flow of fluidized powdery materials, a porous fluidization wall 3, a conduit 4 for the intake of fluidization gas and a conduit 5 for discharge of the fluidization gas from the upper casing portion.

The upper casing portion 2 is also provided with a means (not shown) for introducing the mixture of the two solid phases to be separated, at a regular flow rate, by means of a conduit 6 associated with a flexible sleeve 8.

Disposed at the opposite end to the means for introducing the mixture of the two phases is an overflow 7 which permits the fluidized material to be taken out of the separation apparatus. The overflow 7 is likewise provided with a flexible sleeve **8*a* permitting the separation apparatus to be connected to a fixed downstream transportation circuit (not shown). An oriented intermittent vibratory means 30 imparts to the porous fluidization wall a vibration 9 which is oriented in the opposite direction to the direction of movement of the fluidized bed as represented by the arrow 10. The abovementioned vibration causes the settled solid phase to migrate in the direction indicated by the arrow 11. The vibratory means 30 may be mounted on any portion of the casing so long as it is vibrationally coupled to the porous wall 3**.

Disposed towards the end comprising the means 6 for introducing the mixture of the two solid phases to be separated is a partition 12 which, at its base at the level of the porous wall 3, has an opening 13 whose length is substantially equal to the width of the porous wall 3 and a height which is adapted to slightly larger than the size of the largest grains of the settled phase. The opening 13 may have a controlled closure diagrammatically indicated by the pointed member **13*a*. When the member 13*a* is open or removed, the settled solid phase, inevitably accompanied by a certain amount of fluidized powdery material, is accumulated in the container 14. The partition 12 further includes, at its upper part, an opening 18 permitting discharge of the fluidization air towards the upper casing portion 2**.

In the embodiment shown in the drawing, the container 14 is provided with a lock 15 defined by the sliding valves 16 and 17, and a flexible connector **8*b***.

Opening of the valve 16 permits the settled solid phase to be removed and to pass into the lock 15. Closure of the valve 16 and opening of the valve 17 then provide for discharge of that solid phase without interfering with the operation of the apparatus for the continuous separation of the two solid phases.

In the case where the container 14 is provided at its base with a fluidization means (not shown), the opening 18 of the par ition 12 permits the fluidization gas which flows upwardly in the container 14 to escape by way of the upper casing 2.

In the absence of a lock 15, the settled solid phase is discharged by periodic opening of the opening 13 by the pointed member 13 *a*, the solid phase then being collected in any container or vessel.

Finally, the apparatus according to the invention is suspended by resilient means such as springs 19 which thus permit it to be vibrated by the vibration indicated at 9.

EXAMPLE OF USE OF THE INVENTION

In an industrial installation for feeding alumina to igneous electrolysis tanks 32 for the production of aluminum using the Hall-Heroult process, in which the alumina was conveyed by a fluidized bed process from a storage zone to at least one consumption zone, the apparatus according to the invention was used to effect fluidized bed separation of the two mixed solid phases, one phase being formed by the alumina and the other phase being formed by materials which are not fluidizable under the conditions of fluidization of the one phase, this other phase being agglomerates of alumina ("scales").

The apparatus according to the invention was installed upstream of the fluidized bed alumina conveyor in such a way that only the fluidized solid phase was transferred by said conveyor to the electrolysis cells while the other solid phase which had settled was removed from the transportation installation before interfering with proper operation of the fluidized bed conveyors.

The apparatus according to the invention was 3 meters in length and 60 centimeters in width. The lower casing portion 1 was 10 centimeters in height while the upper casing portion 2 for the flow of fluidized powdery materials was 45 centimeters in height.

The porous fluidization wall 30 was 1.4 square meters in surface area. The pressure of the fluidization gas in the casing was 600 mm WG (5880 Pa) while the cumulative flow rate of the gas was 2 $Nm^3$/min. The apparatus according to the invention was supplied with a mixture of solid phases (alumina and agglomerates) in a regular manner at a rate of 6 metric tons per hour.

The oriented vibration 30 was produced by a vibrator of eccentric weight type, as indicated by the arrow 9. The angle $\alpha$ of the axis of the vibration with a vertical plane was 45°. The frequency of the vibration was 1500 cycles per minute while its amplitude was 4 millimeters.

The vibration was produced for a period of 2 minutes, at a rate of twice per hour.

The installation was operated continuously for a period of 6 months. During that time, 26,000 metric tons of alumina was handled in the apparatus; of that amount it was possible to eliminate, by way of the opening 13, 5,100 kg of the settled solid phase, that is to say approximately on average 0.2 kg of settled solid phase eliminated per metric ton of alumina.

Throughout that period, the fluidized bed apparatus for feeding alumina to electrolysis tanks did not experience any disturbance in operation due to the "scales" or other undesirable agglomerates.

Obviously, numerous modifications and variations of the present invention are possible in light of the above teachings. It is therefore to be understood that within scope of the appended claims, the invention may be practiced otherwise than as specifically described herein.

What is claimed as new and desired to be secured by Letters Patent of the United States is:

1. A fluidized closed bed apparatus for the separation of two mixed solid phases, one of said phases being formed by a fluidized powdery material, the other of said phase being formed by a material which is not fluidized under conditions of fluidization of said one phase, said apparatus comprising:

a closed casing suspended by resilient means, said casing having a lower casing portion for a flow of a fluidizing gas and an upper casing portion for a flow of fluidized powdery materials;

a substantially horizontal porous fluidization wall separating said upper and lower casing portions, said fluidization wall forming an angle of less than 3° with the horizontal;

means for said feeding fluidizing gas to said lower casing portion;

means for discharging said fluidizing gas from the top of said upper casing portion;

means for introducing a mixture of said two phases into said upper casing portion;

means for communicating to said porous wall a periodic vibration having a first component directed towards one end of said casing and a vertical upwardly directed component of a magnitude such that the resultant of said components forms an angle $\alpha$ of between 20 and 60° with the vertical, said periodic vibration having a frequency of between 750 and 1500 cycles per minute and an amplitude of between 2 and 5 mm, wherein said means for communicating include means for intermittently producing said vibration for a period of time of from 1 to 3 minutes and at a rate of from 2 to 4 times per hour, whereby said one phase is fluidized;

overflow means adjacent an end of said casing opposite said one end for discharging said fluidized phase; and means for removing said other phase from adjacent said one end of said casing, said means for removing comprising a partition having an opening at a vertical level of said porous wall.

2. The fluidized bed apparatus according to claim 1, wherein said means for removing said other phase comrpises:

a storage container in fluid communication with said opening of said partition;

a lock below said storage container;

a first valve between said lock and said storage container; and a second valve below said lock.

3. A fluidized bed apparatus according to claim 1 including means for periodically closing said opening of said partition.

4. A process for the separation of two mixed solid phases, one of said phases being formed by a fluidized powdery material, the other of said phases being formed by a material which is not fluidizable under conditions of fluidization of said one phase, said process comprising the steps of:

vibrating a porous fluidization wall within a resiliently suspended closed casing by periodic vibrations for periods of from 1 to 3 minutes and at a rate of from 2 to 4 times per hour, said periodic vibrations having a first component directed towards one end of said casing, a frequency of between 750 and 1500 cycles per minute and an amplitude of between 2 and 15 mm;

feeding a fluidizing gas through said porous fluidization wall and into an upper portion of said casing;

introducing a mixture of said two phases into said upper casing portion, whereby said one of said phases is fluidized;

discharging said fluidized phase from said casing via overflow means adjacent an end of said casing opposite said one end of said casing;

removing said other phase from said casing via an opening at the vertical level of said porous wall in a partition adjacent said one end of said casing; and discharging said fluidizing gas from said upper casing portion.

5. The process of claim 4, wherein said first phase is alumina, and including the step of feeding said separated first phase to a series of tanks for the production of aluminum by igneous electrolysis using a process of the Hall-Heroult type.

* * * * *